US012022926B2

(12) United States Patent
Cotte et al.

(10) Patent No.: US 12,022,926 B2
(45) Date of Patent: Jul. 2, 2024

(54) LUGGAGE COMPRISING A MOTORIZED OPENING PANEL

(71) Applicant: PA.COTTE SA, Pully (CH)

(72) Inventors: Pierre-Alain Cotte, Amberg (DE); Mathieu Porez, Nantes (FR); Fabien Fouquet, Rezé (FR); Victorien Ferre, Nantes (FR)

(73) Assignee: PA.COTTE SA, Pully (CH)

( * ) Notice: Subject to any disclaimer, the term of this patent is extended or adjusted under 35 U.S.C. 154(b) by 47 days.

(21) Appl. No.: 17/798,803

(22) PCT Filed: Feb. 9, 2021

(86) PCT No.: PCT/EP2021/053102
§ 371 (c)(1),
(2) Date: Aug. 10, 2022

(87) PCT Pub. No.: WO2021/160619
PCT Pub. Date: Aug. 19, 2021

(65) Prior Publication Data

US 2023/0055734 A1 Feb. 23, 2023

(30) Foreign Application Priority Data

Feb. 13, 2020 (FR) ..... 2001432

(51) Int. Cl.
*A45C 13/00* (2006.01)
*A45C 5/03* (2006.01)
*A45C 13/04* (2006.01)

(52) U.S. Cl.
CPC ..... *A45C 13/005* (2013.01); *A45C 5/03* (2013.01); *A45C 13/04* (2013.01)

(58) Field of Classification Search
CPC ..... A45C 13/005; A45C 5/03; A45C 13/04; G01D 5/14; E05F 3/20
USPC ..... 16/290, 291; 312/319.2; 190/100, 113, 190/106, 4, 5; 220/211
See application file for complete search history.

(56) References Cited

U.S. PATENT DOCUMENTS 2,903,149 A * 9/1959 Turner ..... E05F 1/1058 217/60 E
9,375,066 B1 6/2016 Velazquez
9,823,631 B1 * 11/2017 Loo ..... G06F 1/1681
11,187,021 B2 * 11/2021 Gherardi ..... E05F 1/1261
(Continued)

FOREIGN PATENT DOCUMENTS

CN 106388194 2/2017
EP 3476715 5/2019

OTHER PUBLICATIONS

International Search Report and Written Opinion issued by the International Searching Authority, dated Apr. 7, 2021, for International Patent Application No. PCT/EP2021/053102; 12 pages.

*Primary Examiner* — Don M Anderson
*Assistant Examiner* — Justin Caudill
(74) *Attorney, Agent, or Firm* — Faegre Drinker Biddle & Reath LLP

(57) ABSTRACT

The invention relates to an item of luggage comprising:
- a casing forming a frame;
- a lid forming an opening panel mobile relative to the frame between a closed position in which it is folded back on the frame, and at least one open position;
- at least one electric motor motorising the opening and the closing of the opening panel.

10 Claims, 6 Drawing Sheets

(56) References Cited

U.S. PATENT DOCUMENTS

| | | | | |
|---|---|---|---|---|
| 2019/0040670 | A1* | 2/2019 | Dora | E05F 15/63 |
| 2019/0077595 | A1* | 3/2019 | Wang | B65F 1/16 |

* cited by examiner

LUGGAGE COMPRISING A MOTORIZED OPENING PANEL

CROSS-REFERENCE TO RELATED APPLICATIONS

The present application is a national stage entry of International (PCT) Patent Application Number PCT/EP2021/053102, filed Feb. 9, 2021, which claims priority to French Patent Application Number 2001432, filed Feb. 13, 2020, the complete disclosures of which are expressly incorporated herein by reference.

The field of the invention is that of designing and manufacturing items of luggage.

The field of the invention is more particularly that of opening and closing mechanisms integrated into items of luggage.

The opening and closing of an opening panel relative to a frame on which the opening panel is mounted mobile can be performed purely manually as is traditional for the field of luggage, or it can be undertaken in a motorised manner as can be observed in other technical fields.

For a design in which actuation is manual only, the opening panel is conventionally coupled to the frame by means of a hinge.

In this case, the opening panel is open or closed simply by being pivoted around a pivot axis formed by the hinge.

According to a conventional design of a mechanism for opening an item of luggage via manual actuation, the mechanism exerts no or little resistance against manipulation of the opening panel by a user.

Therefore a user can easily fold the opening panel back on the frame, in this way having the opening panel shift from an open position to a folded-back position on the frame.

Mechanisms with manual actuation are generally provided with locking means of the opening panel in its folded-back position on the frame.

Such locking means can be constituted by:

- a notch presented by the opening panel on one of its slices;
- a catch presented by the frame and intended to engage in the notch in the folded-back position of the opening panel;
- an actuator coupled to the catch to allow it to retract from the notch during the opening of the opening panel.

The catch can have a bevel and return means in a projecting position. In this way, when the opening panel is folded back it exerts a pressure on the catch and pushes it back, in this way enabling the opening panel to move to its folded-back position. Once it reaches its folded-back position, the notch is now opposite the catch which, under the effect of the return means, engages in the notch and locks the opening panel in its folded-back position.

With respect to motorised mechanisms, the use of electric motors opens and closes an opening panel relative to a frame without the need for human intervention. In this case, it is unnecessary to open or reclose the opening panel manually, the motor itself being capable of carrying out the opening or closing of the opening panel.

These different types of mechanisms each have their own specific characteristics and their intrinsic advantages. The purely manual and mechanical mechanism allows a closing of the opening panel which can be performed naturally and intuitively for a user. The motorised mechanism per se offers automatic closing of the opening panel requiring no direct intervention from the user.

The aim can be to reconcile the advantages of a classic opening mechanism with manual actuation with those of a motorised mechanism.

It is precisely the aim of the invention to propose an item of luggage having a device for opening and closing of the opening panel which reconciles the intuitiveness of manual closing of an opening mechanism with the capacity of automatic closing produced by a motor.

Another aim of the invention is to provide such an item of luggage which triggers automatic locking as an opening panel moves to a folded-back position on its frame.

These aims, along with others to appear hereinbelow, are achieved due to the invention whereof the subject is an item of luggage comprising:

- a casing forming a frame;
- a lid forming an opening panel mobile relative to the frame between a closed position in which it is folded back on the frame, and at least one open position;
- at least one electric motor motorising the opening and the closing of the opening panel; characterised in that it comprises:
- means for determination of an exerted force E on the opening panel and/or a displacement speed D of the opening panel during the application of a force by a user causing a displacement of the opening panel from one of its open positions in the direction of its closed position;
- an electronic unit parameterised with a threshold force S and/or a threshold speed V; and in that the electronic unit is also parameterised to control the electric motor so that it draws the opening panel into a closed position if the exerted force E is greater than or equal to the threshold force S, or if the displacement speed D is greater than or equal to the threshold speed V.

Thanks to the item of luggage according to the invention, a user can trigger an automatic closing of the lid by initiating this closing manually.

Indeed, this user has no need to fully support the closing of the lid by way of the electric motor which takes over the movement initiated manually.

As a result, the automatic closing by means of the motor is initiated particularly intuitively.

This automatic closing is more precisely performed as soon as the user exerts a sufficient force on the lid. The force is detected by the determination means which receive the exerted force or the displacement speed of the opening panel resulting from the action of the user. The exerted force or the displacement speed is then compared to the threshold force or the threshold speed to allow triggering of the control of the electric motor by the electronic unit in the event where the exerted force E or the displacement speed D has reached or exceeded the threshold force S or the threshold speed S.

This automatic closing by the electric motor also ensures that the opening panel moves properly into the closed position.

With an item of luggage according to the prior art having a conventional mechanism via manual actuation, a user can initiate the closing of the lid and lets it fall back onto the casing of the item of luggage. This kinematic locks the lid in a closed position. But it can be noted in some situations in which the lid fails to reach its closed and locked position for example if the inertia conferred to the lid during the initiation of the closing is insufficient.

Also, the lid can fall back onto the casing suddenly, risking progressively degrading the item of luggage.

The automatic closing of the lid of the item of luggage according to the invention avoids these situations. Therefore when a user initiates closing manually, the latter is terminated securely and controlled (not suddenly) by the electric motor, and the user can take hold of the item of luggage and move it without accidental risk of opening.

Advantageously, the item of luggage comprises a hinge between the opening panel and the frame, the electric motor cooperating with the hinge for opening or closing the opening panel, and the determination means comprise a first position sensor of a member of the hinge, called "control unit", the determination means being parameterised to calculate the exerted force E from displacement of the control unit engendered by the application of the force on the opening panel as well as a resistance to this displacement exerted by the electric motor, and/or calculating the displacement speed of the opening panel from a displacement of the control unit engendered by the application of the force on the opening panel.

In this way, detection of the force exerted on the opening panel, and/or of the speed of this opening panel is done by way of a member of the hinge. This determination is carried out indirectly.

Also, because it is located on this hinge, the position of the control unit determines the position of the opening panel relative to the frame, as well as the evolutions in position of the opening panel relative to the frame due to evolutions in the position of this control unit.

In this case, according to a preferred design, the hinge comprises:

- a mechanism for conversion of a rotation movement of the electric motor into a translation movement, the conversion mechanism comprising a transmission member mobile in translation along an axis of translation T;
- a coupling member coupled by a first of its ends to the opening panel on a first pivot point offset by an axis of rotation of the opening panel, and by a second of its ends to the transmission member on a second pivot point, a translation of the transmission member according to a first direction causing opening of the opening panel, and a translation of the transmission member according to a second direction causing closing of the opening panel; the transmission member forming the control unit.

This design of the hinge enables the control unit to be formed by a member of the conversion mechanism for transmitting movement produced by the electric motor to the opening panel.

As a consequence, the displacement of the control unit can be correlated safely and certainly with a displacement of the opening panel.

According to a preferred characteristic, the opening panel is:

- mobile relative to the frame between a maximal opening position and an intermediate opening position in which the opening panel is directly positioned in the proximity of its closed position and projects relative to the frame;
- mobile relative to the frame between the intermediate opening position and the closed position;

and the electronic unit is also parameterised to control the electric motor so that it tends to hold the opening panel in its intermediate opening position by exerting a resistance R going against a translation of the opening panel in its intermediate opening position to its closed position, with the resistance R being equal to the threshold force S.

According to this embodiment, the opening panel assumes a position close to its closed position, which it tends to maintain.

Such intermediate opening position can for example prevent the opening panel from adopting a position in which it can be very difficult to grasp by a user, for example to interrupt its closing or to reopen it.

This intermediate opening position can also impart to the luggage a relatively sophisticated opening kinematics and likely to impart a qualitative aspect to the item of luggage.

In its intermediate opening position, it is only during the application of a force greater than or equal to the resistance exerted by the electric motor (and therefore equivalent to the threshold force) when the opening panel will be able to move to its closed position under the action of the electric motor.

Advantageously, the opening panel is:

- mobile in rotation relative to the frame between the maximal opening position and the intermediate opening position;
- mobile in translation relative to the frame between the intermediate opening position and the closed position.

The opening panel has qualitative and/or attractive opening kinematics.

In this case, according to a preferred characteristic, the hinge comprises at least one mobile mount mounted mobile in translation on at least one guide element in translation presented by the frame, and the opening panel is mounted at least mobile in rotation on the mobile mount or mounts.

According to an advantageous design, the frame has a framework delimiting a location occupied by the opening panel in its closed position, and the determination means comprise at least one second position sensor of the opening panel relative to the framework, positioned in the immediate proximity of the framework, the second position sensor or sensors being independent of the first position sensor or sensors, the determination means being parameterised to calculate the exerted force E from a signal of the second sensor or sensors engendered by the application of a force on the opening panel in its intermediate opening position to the exerted force.

A second sensor, or several second sensors, ensure(s) that the force applied to the opening panel to close it is fully captured by the determination means.

Indeed, because the first sensor determines the exerted force on the opening panel indirectly, the integration of other sensors ensures that a force exerted on the opening panel is correctly determined.

In this case, according to a preferred design, the second sensor or sensors is/are positioned in the immediate proximity of a leading edge of the framework, opposite a trailing edge of the framework, the hinge being positioned in the frame on the side of the trailing edge of the framework.

This design compensates the phenomenon of a lever and the appearance of a parasitic moment in the event where someone exerts a force on a part of the opening panel which is opposite to the hinge.

More precisely, in the event where someone exerts a force tending to close the opening panel onto a leading edge opposite the trailing edge of the opening panel, then this force produces a lever effect on the hinge and this force is not correctly captured by the first sensor or sensors due to the presence of a parasitic moment in the region of the hinge.

Also, the positioning of one or more second sensors in the immediate proximity of the leading edge of the framework compensates this parasitic moment and ensures that the force applied to the opening panel is correctly determined.

In the end, a force of the same intensity causes the automatic closing of the opening panel, whether this force is applied to a part or a rear part of the opening panel.

According to a preferred characteristic, the second sensor or sensors is/are Hall effect sensors, and the opening panel bears a magnet or magnets positioned opposite the Hall effect sensor or sensors.

Such Hall effect sensors determine the position of the opening panel relative to the framework due to the capacity of these sensors to determine the position of an object by means of the magnetic fields.

Other characteristics and advantages of the invention will emerge more clearly from the following description of preferred embodiments of the invention given by way of illustrative and non-limiting examples, and the appended drawings, in which.

Figure 1:
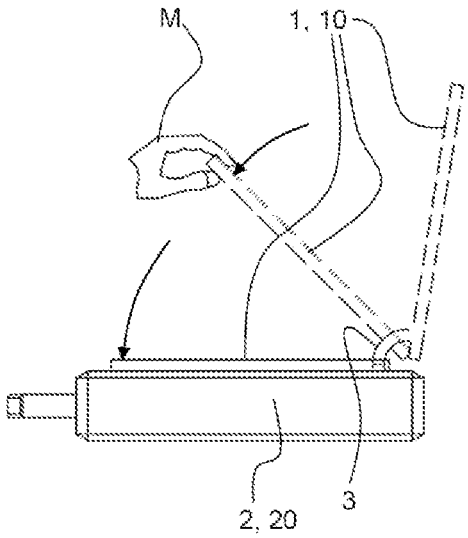
FIG. 1 is a schematic side illustration of an item of luggage according to a first embodiment of the invention, comprising a casing and a lid, for which closing kinematics of the lid is represented.

An item of luggage according to the invention is illustrated by FIGS. 1 to 6.

The item of luggage comprises a casing 20 and a lid 10 mounted mobile on the casing 20.

The casing 20 forms a frame 2, and the lid forms an opening panel 1.

In other terms, the opening panel 1 is mounted mobile relative to the frame 2.

In reference to FIGS. 1 to 6, the opening panel 1 is mobile between a closed position and at least one open position.

In its closed position, the opening panel 1 is folded back on the frame 2.

According to FIG. 3, and as is detailed hereinbelow, the frame 2 has a framework 200. This framework 200 delimits a location which is occupied by the opening panel 1 in its closed position F.

Figure 2:
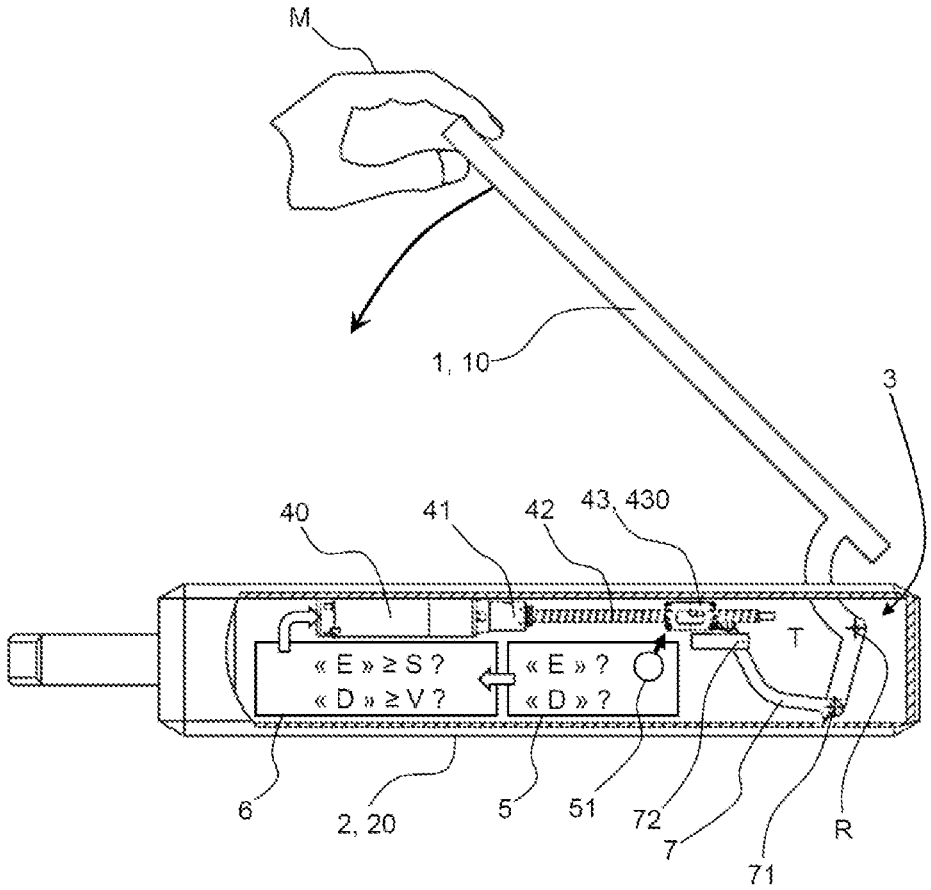
FIG. 2 is a schematic side illustration of an opening mechanism of the item of luggage according to the first embodiment of the invention.

In reference to the first embodiment illustrated by FIGS. 1 and 2, the opening panel 1 is mounted mobile in rotation solely on the frame 2.

In reference to the second embodiment illustrated by FIGS. 3 to 6, the opening panel 1 has an opening or closing kinematics more complex relative to the first embodiment.

More precisely, the opening panel 1 is:

- mobile in rotation relative to the frame (2) between a maximal opening position and an intermediate opening position;
- mobile in translation relative to the frame 2 between the intermediate opening position and the closed position.

Figure 5:
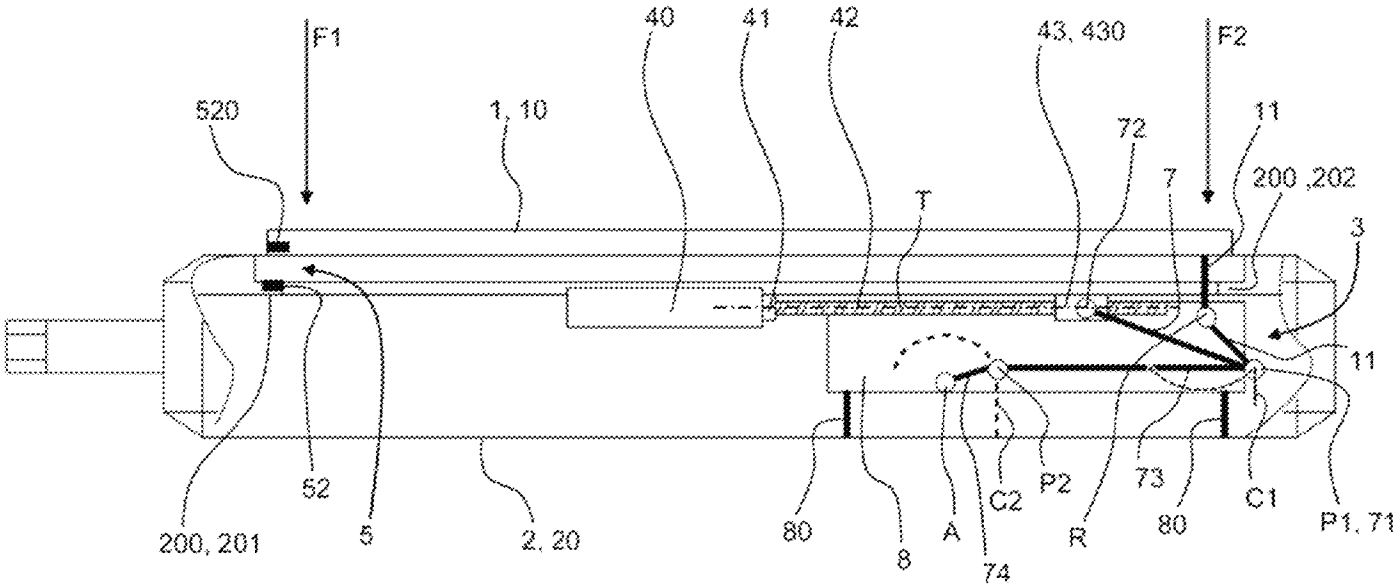
FIG. 5 is a schematic illustration according to a sectional side view of an item of luggage, according to the second embodiment, with its lid in an intermediate opening position.

The intermediate opening position, illustrated by FIG. 5, corresponds especially to a position in which the opening panel 1 is sufficiently moved away from its closed position, by means of translation, so that it can be grasped by a user of the item of luggage.

Of course, the item of luggage according to the first embodiment can also have an opening panel 1 which, while being mounted solely mobile in rotation, has an intermediate opening position comparable to that of the second embodiment.

To allow mobility of the opening panel 1 on the frame 2, the item of luggage comprises a hinge 3 between the opening panel 1 and the frame 2.

The hinge 3 is described more precisely hereinbelow in reference to the two embodiments.

The item of luggage also comprises:

- at least one electric motor 40;
- means for determination 5 of an exerted force E on the opening panel 1 and/or a displacement speed D of the opening panel 1 during the application of a force by a user causing displacement of the opening panel 1 from one of its open positions in the direction of its closed position;
- an electronic unit 6 coupled to the electric motor 40 and the determination means 5.

The electric motor or motors 40 motorise the opening and the closing of the opening panel 1. For this purpose, the electric motor or motors 40 cooperate with the hinge 3.

According to the present embodiments, the item of luggage comprises especially two electric motors 40.

These electric motors 40 are brushed direct-current motors. Each electric motor 40 is also equipped with a reducer 41 and produces a rotation movement.

The hinge comprises more precisely two sub-assemblies including a left sub-assembly and a right sub-assembly each cooperating with one of the two electric motors 40.

Of course, it is possible for the hinge 3 to comprise two sub-assemblies one of which cooperates with a single electric motor 40.

As explained earlier, thanks to the determination means 5 it is possible to receive the exerted force E on the opening panel and/or a displacement speed D of the opening panel 1.

The exerted force E results from a manual actuation by a user, or in other terms of the gripping of the opening panel 1 by a hand M of the user and the application of a force to close the opening panel 1.

These determination means 5 are described in more detail hereinbelow.

Also, according to the invention, the electronic unit 6 is parameterised with a threshold force S and/or a threshold speed V.

For example this threshold force S can be equal to 20 N.

The exerted force E is used by the electronic unit 6 which is parameterised to control the electric motor 40 so that it draws the opening panel 1 into a closed position if the exerted force E is greater than or equal to the threshold force S.

According to another example, the threshold speed V can correspond to an angular speed of rotation of the opening panel 1 determined experimentally to correspond to a speed sufficient to allow the opening panel 1 to move from an open position to its intermediate opening position.

In this case, as soon as the displacement speed D is greater than or equal to the threshold speed C, the electronic unit 6 controls the electric motor 40 so that once the opening panel 1 reaches its intermediate opening position, it guides its passage from this intermediate opening position to its closed position.

The item of luggage also comprises means for shutting-off the electric motor 40.

These means for shutting-off the electric motor 40 are configured to interrupt the closing of the opening panel 1 by the electric motor 40 following the detection of a resistance going against the closing of the opening panel.

As is subsequently detailed, this resistance is detected by determination means 5.

The electric motor or motors 40 can mobilise the opening panel 1 on the frame 2 by means of the design described hereinbelow of the coupling of the electric motor or motors 40 to the hinge 3.

Figure 4:
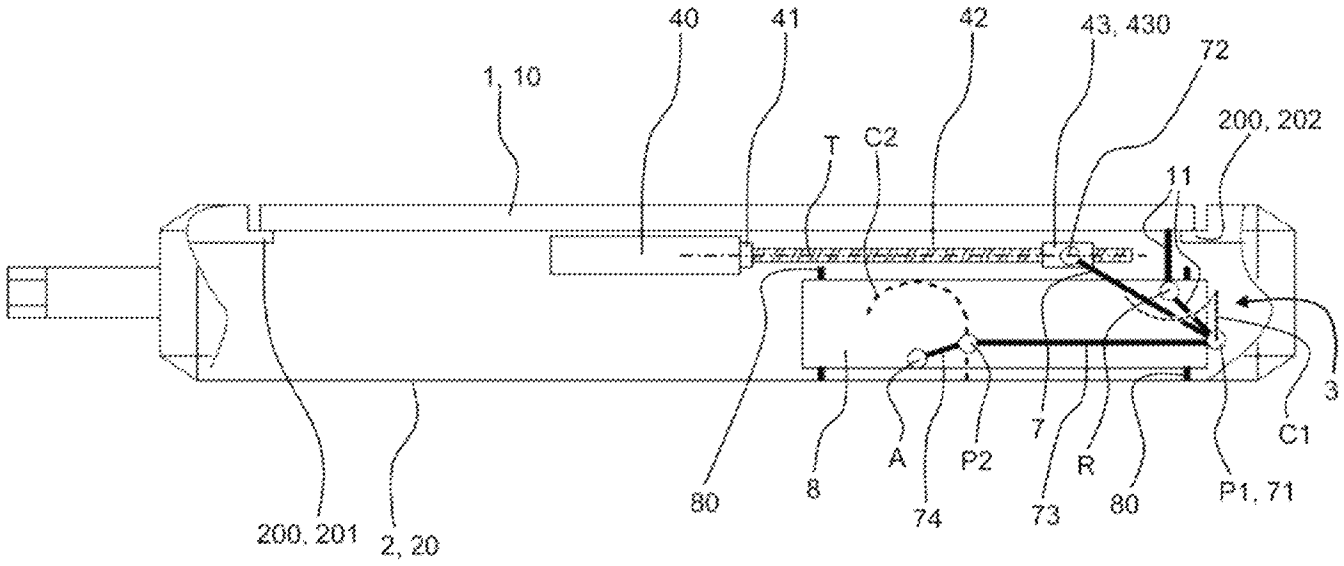
FIG. 4 is a schematic illustration according to a sectional side view of an item of luggage, according to the second embodiment, with its lid in a closed position.
Figure 6:
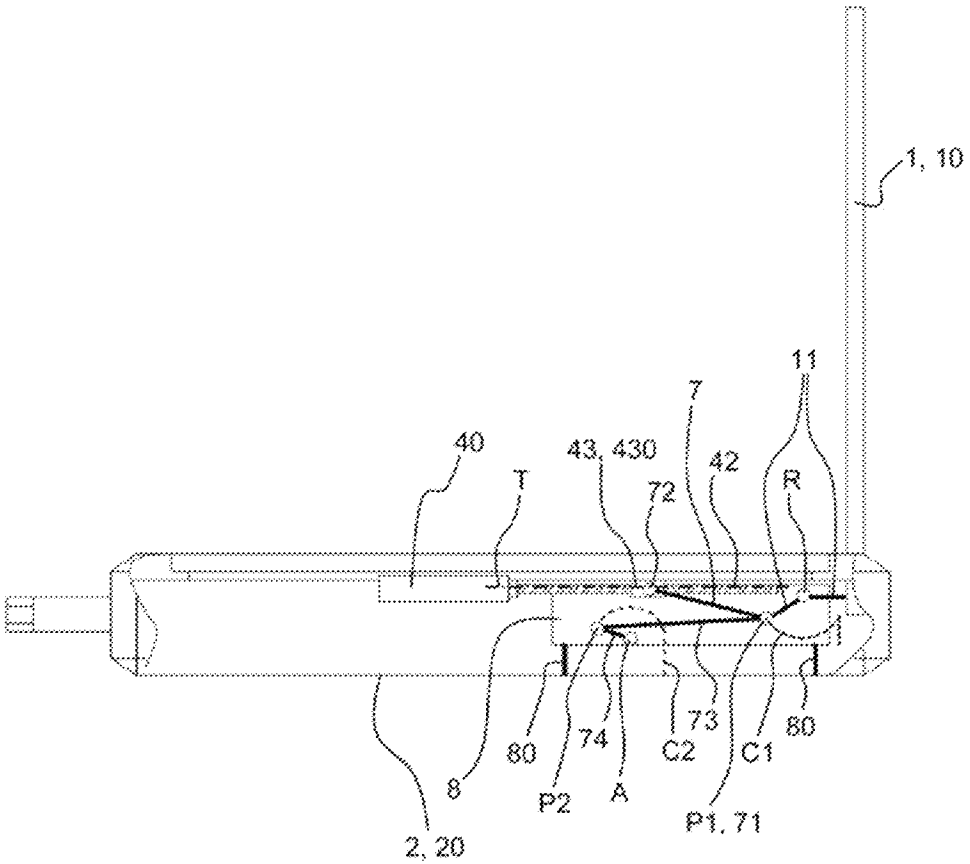
FIG. 6 is a schematic illustration according to a sectional side view of an item of luggage, according to the second embodiment, with its lid being in a maximal opening position.

In reference to FIG. 2, and to FIGS. 4 to 6, the hinge 3 comprises a mechanism for conversion of a rotation movement into a translation movement.

This conversion mechanism comprises an intermediate member 43 which is mobile in translation under the effect of the electric motor 40.

In reference to FIG. 2:

- the motor 40 and the reducer 41 drive a screw 42 in rotation;
- the conversion mechanism corresponds to a ball screw, the intermediate member 43 being more particularly a nut 430.

The nut 430 is coupled on the screw 42.

The intermediate member 43, and more particularly the nut 430, is mobile along an axis of translation T which is formed by the extension axis of the screw 42.

According to the first embodiment illustrated by FIG. 2, in which the opening panel 1 is mounted mobile in rotation solely on the frame 2, the hinge 3 also comprises a transmission arm 7 which couples the intermediate member 43 to the opening panel 1. More particularly, the transmission arm 7 couples the intermediate member 43 to the lid 10.

As illustrated by FIG. 2, the transmission arm 7 is more precisely coupled by a first end to the opening panel 1 on a first pivot point 71 which is offset by the axis of rotation R of the opening panel 1. The transmission arm 7 is also coupled by a second end, opposite the first end, to the intermediate member 43 on a second pivot point 72.

The device 1 is configured so that translation of the intermediate member 43 according to a first direction causes the opening of the opening panel 1, and a translation of the intermediate member 43 according to a second direction causes the closing of the opening panel 1.

According to the second embodiment illustrated by FIGS. 4 to 6, in which the opening panel 1 has a mobility in translation between its intermediate opening position and its closed position, the hinge 3 has the same characteristics as those of the first embodiment, and also comprises at least one mobile mount 8 mounted mobile in translation on at least one guide element 80 in translation presented by the frame 2.

More precisely, the hinge 3 comprises two mobile mounts 8, namely a mobile mount 8 for each sub-assembly.

The opening panel 1 is mounted mobile in rotation on the mobile mount or mounts 8.

Additional cam paths, including a first cam path C1 and a second cam path C2 presented by the frame 2 and/or by the mobile mounts 8, transform the translation movement of the intermediate member 43 along the axis of translation T into a translation movement of the opening panel 1, or into a rotation movement of the opening panel 1.

More specifically, according to the embodiment illustrated by FIGS. 4 to 6, the mobile mount 8 bears the axis of rotation R and a second axis of rotation A;

In addition, the opening panel 1 comprises a fixed part 11 extending inside the casing 20 in the closed position of the opening panel 1. This fixed part is connected to a main plane of the opening panel 1.

The fixed part 11 cooperates with the mobile mount 8 so that the opening panel 1 can be mobile in rotation around the axis of rotation R.

According to the present embodiment, the hinge 3 comprises:

- a first cam P1 mobile in the first cam path C1, the first cam P1 also being the first pivot point 71 to which the transmission arm 7 is coupled;
- a second cam P2 mobile in the second cam path C2;
- a second transmission arm 73 coupled to the first cam P1 at one end and to the second cam P2 at a second end;
- a third transmission arm 74 coupled to the second cam P2 at one end and to the second axis of rotation A at a second end.

As illustrated by FIGS. 4 and 5, the translation of the intermediate member 43 along a first section of the screw 42 causes a translation of the mobile mount 8 between a low position and a high position, and accordingly a translation of the opening panel 1 between its closed position and its intermediate opening position.

This translation of the mobile mount 8 is allowed due to the first cam path C1 and the second cam path C2 which have each a rectilinear portion. The translation of the intermediate member 43 along the first section of the screw 42 causes, thanks to the transmission arm 7, the second transmission arm 73, the third transmission arm 74, as well as the loads exerted by the cam paths, the displacement of the first cam P1 and the second cam P2 solely along rectilinear portions of their respective cam path.

As illustrated by FIGS. 5 and 6, the translation of the intermediate member 43 along a second section of the screw 42 causes a rotation of the opening panel 1 around the axis of rotation R which is located on the mobile mount or mounts 8, and therefore a rotation of the opening panel 1 relative to the frame 2.

This rotation of the opening panel 1 is allowed due to the first cam path C1 and the second cam path C2 each having a curved portion which prolongs their rectilinear portion. The translation of the intermediate member 43 along the second section of the screw 42 per se causes, thanks to the transmission arm 7, the second transmission arm 73, the third transmission arm 74, as well as the loads exerted by the cam paths, the displacement of the first cam P1 and of the second cam P2 solely along the curved portions of their respective cam path. The first cam P1 and the second cam P2 are more specifically driven in rotation respectively around the axis of rotation R and the second axis of rotation A.

As explained earlier, the determination means 5 receive the exerted force E and/or a displacement speed D of the opening panel 1.

Primarily, this determination is carried out indirectly.

Indeed, the determination means 5 comprise a first position sensor 51 of a member of the hinge, called "control unit".

The determination means 5 are parameterised to calculate the exerted force E, and/or the displacement speed D of the opening panel 1, from a displacement of the control unit engendered by the application of the force on the opening panel 1.

According to the present embodiments, the transmission member 43 forms the control unit.

More precisely, the first position sensor 51 determines the position of the intermediate member 43, and more precisely of the nut 430, along its axis of translation T. The position of the opening panel 1 relative to the frame 2 is then correlated to the position of the intermediate member 43 along the axis of translation T.

The evolution of the position of the intermediate member 43 along the axis of translation T especially determines the evolution of the position of the opening panel 1.

In other terms, the real position of the nut 430 and its displacement speed allow the determination means to calculate the position of the opening panel 1 and its displacement speed D.

Also, by being coupled to the electric motor 40, the determination means 5 integrate an instant motor torque value delivered by the electric motor, or even resistant torque if the motor exerts a torque going against a rotation of the screw 42 and a displacement of the intermediate member 43.

The set of these data (torque of the electric motor 40, real position of the nut 430 and instant speed of the nut 430) determines a resistance to closing of the opening panel 1 exerted by the electric motor 40, and performs calculation, by the determination means 5, of the value of the exerted force E.

In reference to the second embodiment illustrated by FIGS. 4 to 6, and in which the opening panel 1 can adopt an intermediate opening position (FIG. 5), the electronic unit 6 is also parameterised to control the electric motor 40 so that it tends to hold the opening panel 1 in its intermediate opening position.

The electric motor 40 uses its coupling to the determination means 5 to exert a resistance R (or a resistant torque) going against a translation of the opening panel 1 from its intermediate opening position to its closed position.

Advantageously the resistance R is equal to the threshold force S.

The opening panel 1 in its intermediate opening position remains in its intermediate opening position if a user applies a force on the opening panel 1 to close it and this force does not produce an exerted force E equal to or greater than the threshold force S.

As soon as the user exerts a sufficient force and the exerted force E is equal to or greater than the threshold force S, the motor causes the closing of the opening panel 1 by causing it to move into the closed position.

Secondarily, the determination of the exerted force E can be performed directly.

Figure 3:
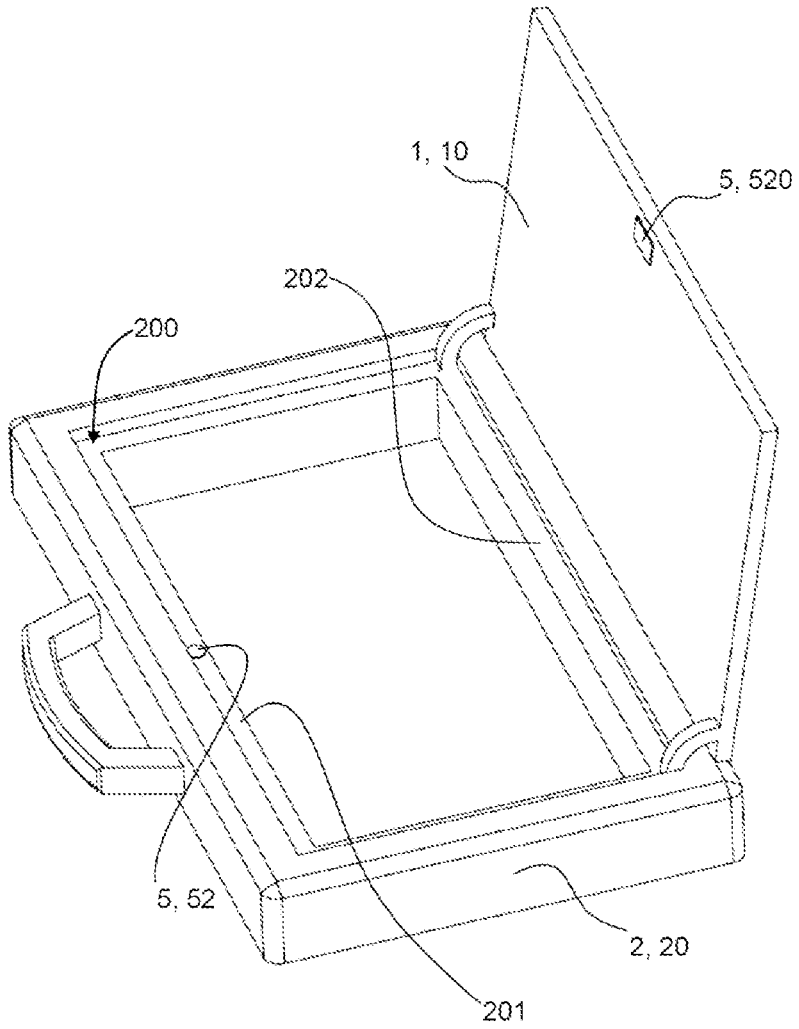
FIG. 3 is a perspective view of an open item of luggage according to a second embodiment of the invention.

Indeed, in reference to FIGS. 3 and 5, the determination means 5 comprise a second position sensor 52 of the opening panel 1 relative to the framework 200. This second sensor 52 is naturally independent of the first sensor 51.

This second sensor 52 is positioned in the immediate proximity of the framework 200.

More precisely, the second sensor 52 is positioned in the immediate proximity of a leading edge 201 of the framework 200, opposite a trailing edge 202 of the framework 200, the hinge 3 being positioned in the frame 2 on the side of the trailing edge 202 of the framework 200.

According to the present embodiment the second sensor 52 is a Hall effect sensor and a complementary magnet 520 of the Hall effect sensor is borne by the opening panel opposite the second sensor 52.

Such a Hall effect sensor measures a variation in magnetic field and detects the position of the magnet 520 relative to the second sensor 52 and determines the position of the opening panel 1 relative to the leading edge 201 of the framework 200.

The determination means 5 are parameterised to correlate a signal of the second sensor 52 engendered by the application of a force on the opening panel 1 in its intermediate opening position to the exerted force E.

In reference to FIG. 5, such a second sensor 52 compensates the presence of a parasitic moment resulting from a lever effect, in the event where a first force F1 is applied to a front part of the opening panel 1. Indeed, the application of a force to a front part of the opening panel 1 causes the occurrence of a parasitic moment due to the distance of the front part from the opening panel 1 relative to the hinge 3.

Thus, in being integrated into the hinge 3 the first sensor allows better detection of a second force F2 applied to a rear part of the opening panel 1, in the proximity of the hinge 3, compared to the detection of the first force F1.

The second sensor 52 finally corrects the determined force and heightens precision of the determination means 5 to obtain the proper exerted force E.

The invention claimed is:

1. An item of luggage comprising:

a casing forming a frame;

a lid forming an opening panel mobile relative to the frame between a closed position in which it is folded back on the frame, and at least one open position;

at least one electric motor motorising the opening and the closing of the opening panel;

characterised in that it comprises:

means for determination of an exerted force (E) on the opening panel and/or a displacement speed (D) of the opening panel during the application of a force by a user causing a displacement of the opening panel from one of its open positions in the direction of its closed position;

an electronic unit parameterised with a threshold force (S) and/or a threshold speed (V);

and in that the electronic unit is also parameterised to control the electric motor so that it draws the opening panel into a closed position if the exerted force (E) is greater than or equal to the threshold force (S), or if the displacement speed (D) is greater than or equal to the threshold speed (V).

2. The item of luggage according to claim 1, wherein it comprises a hinge between the opening panel and the frame, the electric motor cooperating with the hinge for opening or closing the opening panel, and in that the determination means comprise a first position sensor of a member of the hinge, called "control unit", the determination means being parameterised to calculate the exerted force (E) from displacement of the control unit engendered by the application of the force on the opening panel as well as resistance to this displacement exerted by the electric motor, and/or calculating the displacement speed (D) of the opening panel from a displacement of the control unit engendered by the application of the force on the opening panel.

3. The item of luggage according to claim 1, wherein the hinge comprises:

a mechanism for conversion of a rotation movement of the electric motor into a translation movement, the conversion mechanism comprising a transmission member mobile in translation along an axis of translation (T);

a coupling member coupled by a first of its ends to the opening panel on a first pivot point offset by an axis of rotation (R) of the opening panel, and by a second of its ends to the transmission member on a second pivot point, a translation of the transmission member according to a first direction causing opening of the opening panel, and a translation of the transmission member according to a second direction causing closing of the opening panel; the transmission member forming the control unit.

4. The item of luggage according to claim 1, wherein the opening panel is:

mobile relative to the frame between a maximal opening position and an intermediate opening position in which the opening panel is directly positioned in the proximity of its closed position and projects relative to the frame;

mobile relative to the frame between the intermediate opening position and the closed position;

and in that the electronic unit is also parameterised to control the electric motor so that it tends to hold the opening panel in its intermediate opening position by exerting a resistance (R) going against a displacement of the opening panel in its intermediate opening position to its closed position, with the resistance (R) being equal to the threshold force (S).

5. The item of luggage according to claim 1, wherein the opening panel is:

mobile in rotation relative to the frame between the maximal opening position and the intermediate opening position;

mobile in translation relative to the frame between the intermediate opening position and the closed position.

6. The item of luggage according to claim 1, wherein the hinge comprises at least one mobile mount mounted mobile in translation on at least one guide element in translation presented by the frame, and in that the opening panel is mounted at least mobile in rotation on the mobile mount or mounts.

7. The item of luggage according to claim 4, wherein the frame has a framework delimiting a location occupied by the opening panel in its closed position, and in that the determination means comprise at least one second position sensor of the opening panel relative to the framework, positioned in the immediate proximity of the framework, the second position sensor or sensors being independent of the first position sensor or sensors, the determination means being parameterised to calculate the exerted force (E) from a signal of the second sensor or sensors engendered by the application of a force on the opening panel in its intermediate opening position.

8. The item of luggage according to claim 7, wherein the second sensor or sensors is/are positioned in the immediate proximity of a leading edge of the framework, opposite a trailing edge of the framework, the hinge being positioned in the frame on the side of the trailing edge of the framework.

9. The item of luggage according to claim 7, wherein the second sensor or sensors is/are Hall effect sensors, and in that the opening panel bears a magnet or magnets positioned opposite the Hall effect sensor or sensors.

10. The item of luggage according to claim 1, wherein it comprises shut-off means of the electric motor configured to interrupt closing of the opening panel by the electric motor following the detection of a resistance going against the closing of the opening panel.

* * * * *